US009376645B2

(12) United States Patent
Yaguchi et al.

(10) Patent No.: US 9,376,645 B2
(45) Date of Patent: Jun. 28, 2016

(54) LUBRICATING OIL COMPOSITION FOR INTERNAL COMBUSTION ENGINE

(71) Applicant: JX Nippon Oil & Energy Corporation, Tokyo (JP)

(72) Inventors: Akira Yaguchi, Tokyo (JP); Kazuhiro Yagishita, Tokyo (JP); Koji Hoshino, Tokyo (JP); Shigeki Matsui, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 14/376,898

(22) PCT Filed: Nov. 13, 2012

(86) PCT No.: PCT/JP2012/079338

§ 371 (c)(1),
(2) Date: Aug. 6, 2014

(87) PCT Pub. No.: WO2013/118363

PCT Pub. Date: Aug. 15, 2013

(65) Prior Publication Data

US 2015/0005208 A1 Jan. 1, 2015

(30) Foreign Application Priority Data

Feb. 7, 2012 (JP) ..... 2012-023952

(51) Int. Cl.

| | |
|---|---|
| ***C10M 163/00*** | (2006.01) |
| ***C10M 135/36*** | (2006.01) |
| ***C10M 173/02*** | (2006.01) |
| ***C10M 135/22*** | (2006.01) |
| ***C10M 141/10*** | (2006.01) |
| ***C10M 141/08*** | (2006.01) |
| ***C10M 169/04*** | (2006.01) |

(52) U.S. Cl.

CPC ..... *C10M 141/08* (2013.01); *C10M 163/00* (2013.01); *C10M 169/042* (2013.01); *C10M 2201/087* (2013.01); *C10M 2203/1025* (2013.01); *C10M 2207/262* (2013.01); *C10M 2209/084* (2013.01); *C10M 2215/064* (2013.01); *C10M 2215/28* (2013.01); *C10M 2219/068* (2013.01); *C10M 2223/045* (2013.01); *C10N 2210/02* (2013.01); *C10N 2210/06* (2013.01); *C10N 2230/02* (2013.01); *C10N 2230/06* (2013.01); *C10N 2230/45* (2013.01); *C10N 2230/68* (2013.01); *C10N 2240/10* (2013.01)

(58) Field of Classification Search

CPC ..... C10M 2219/046; C10M 2203/045; C10M 2219/068

USPC ..... 508/186, 272, 528, 569, 408

See application file for complete search history.

(56) References Cited

U.S. PATENT DOCUMENTS

| | | | | |
|---|---|---|---|---|
| 2005/0107269 | A1 | 5/2005 | Yagishita et al. | |
| 2007/0179070 | A1 * | 8/2007 | Kurihara | C10M 163/00 508/460 |
| 2008/0020952 | A1 * | 1/2008 | Yagishita | 508/186 |
| 2012/0283159 | A1 * | 11/2012 | Matsui et al. | 508/186 |

FOREIGN PATENT DOCUMENTS

| | | | |
|---|---|---|---|
| EP | 2522709 | A1 | 11/2012 |
| JP | H06-306384 | A | 11/1994 |
| JP | H08-302378 | A | 11/1996 |
| JP | 2001012884 | A | 1/2001 |
| JP | 2001-279287 | A | 10/2001 |
| JP | 2002-129182 | A | 5/2002 |
| JP | 2002220597 | A | 8/2002 |
| JP | 2004-083891 | A | 3/2004 |
| JP | 2007-217494 | A | 8/2007 |
| JP | 2010-180420 | A | 8/2010 |
| WO | 2011083601 | A1 | 7/2011 |

OTHER PUBLICATIONS

Int'l Search Report issued Dec. 18, 2012 in Int'l Application No. PCT/JP2012/079338.

Extended Search Report issued Sep. 16, 2015 in EP Application No. 12868246.5.

* cited by examiner

*Primary Examiner* — Vishal Vasisth

(74) *Attorney, Agent, or Firm* — Panitch Schwarze Bellisario & Nadel LLP

(57) ABSTRACT

The present invention provides a lubricating oil composition for internal combustion engines which can reduce sufficiently the friction under mixed lubricating conditions and is excellent in fuel saving properties. The lubricating oil composition comprises (A) a base oil having a 100° C. kinematic viscosity of 2 to 8 $mm^2/s$ and an aromatic content of 10 percent by mass or less, (B) a metallic detergent having a metal ratio of 1.01 to 3.3 overbased with an alkaline earth metal borate, and (C) an organic molybdenum compound with a molybdenum concentration of 0.01 to 0.2 percent by mass on the basis of the total mass of the composition, and having a 100° C. HTHS viscosity of 5.5 mPa·s or lower.

6 Claims, No Drawings

LUBRICATING OIL COMPOSITION FOR INTERNAL COMBUSTION ENGINE

CROSS-REFERENCE TO RELATED APPLICATION

This application is a Section 371 of International Application No. PCT/JP2012/079338, filed Nov. 13, 2012, which was published in the Japanese language on Aug. 15, 2013, under International Publication No. WO 2013/118363 A1, and the disclosure of which is incorporated herein by reference.

TECHNICAL FIELD

The present invention relates to lubricating oil compositions for internal combustion engines.

BACKGROUND ART

Conventionally, lubricating oil has been used in an internal combustion engine, a transmission or other mechanical devices to facilitate the smooth operation thereof. In particular, a lubricating oil (engine oil) for an internal combustion engine is required to have a high level of performances because the internal combustion engine has been improved in performance, enhanced in output and used under severe working conditions. Therefore, conventional engine oils have been blended with various additives such as antiwear agents, metallic detergents, ashless dispersants, and anti-oxidants to meet such requisite performances (for example, see Patent Literatures 1 to 3 below). Furthermore, recently the fuel saving performance of the lubricating oil has been required to be increasingly better and better, and thus applications of a high viscosity index base oil or various friction modifiers have been studied (for example, see Patent Literature 4 below).

CITATION LIST

Patent Literature

Patent Literature 1: Japanese Patent Application Publication No. 2001-279287

Patent Literature 2: Japanese Patent Application Publication No. 2002-129182

Patent Literature 3: Japanese Patent Application Laid-Open Publication No. 08-302378

Patent Literature 4: Japanese Patent Application Laid-Open Publication No. 06-306384

As general fuel saving techniques, it is known to reduce the kinematic viscosity of lubricating oil and enhance the viscosity index thereof (multi-grading that is a combination of a low viscosity base oil and a viscosity index improver). An alternative technique is a method wherein friction is reduced under lubricating conditions where solid bodies contact, i.e., under mixed lubricating conditions. For engines, this type of lubricating conditions occurs in the driving valve system driving the valves or at the top dead center or bottom dead center of the pistons at slow speed. In order to reduce this friction, an additive is adsorbed to the parts at which contact between solid bodies occurs to reduce the contact. This additive is generally referred to as "friction modifier".

Although various compounds have been used as friction modifiers, they have a basic structure having in the same compound a straight-chain alkyl or alkenyl and a polar group capable of adsorbing to metal surfaces. Examples of the polar group include various groups such as carboxylic acid, amine, amide, hydroxyl group, phosphoric acid, phosphorous acid and the like. There are a large number of compounds where a plurality of polar groups that are of the same or different type exist per molecule, and the structures thereof are extremely complicated. An organic molybdenum compounds are known as a highly effective friction modifier.

In order to further improve the fuel saving properties, blend of a high performance base oil or addition of a high performance viscosity index improver other than addition of a friction modifier has been attempted, and the fuel saving properties has been improved. However, the reality is that further improvement in fuel saving properties has been demanded.

The present invention has been made in view of the above current situations and has an object to provide a lubricating oil composition for an internal combustion engine, which is reduced in kinematic viscosity and high temperature high shear viscosity as well as in low temperature viscosity while reducing sufficiently friction under mixed lubricating conditions to have further excellent fuel saving properties.

Solution to Problem

In order to achieve the above object, the present invention provides a lubricating oil composition for an internal combustion engine described below:

[1] an internal combustion engine lubricating oil composition comprising (A) a base oil having a 100° C. kinematic viscosity of 2 to 8 $mm^2/s$ and an aromatic content of 10 percent by mass or less, (B) a metallic detergent having a metal ratio of 1.01 to 3.3 overbased with an alkaline earth metal borate, and (C) an organic molybdenum compound with a molybdenum concentration of 0.01 to 0.2 percent by mass on the basis of the total mass of the composition, and having a 100° C. HTHS viscosity of 5.5 mPa·s or lower;

[2] the internal combustion engine lubricating oil composition according to [1] above wherein (B) the metallic detergent overbased with an alkaline earth metal borate is an alkaline earth metal salicylate;

[3] the internal combustion engine lubricating oil composition according to [1] or [2] wherein (B) the metallic detergent is a metallic detergent produced by overbasing a mixture of (B-1) 55 to 100 percent by mass of a metallic detergent having an alkyl or alkenyl group having 8 to 19 carbon atoms and (B-2) 0 to 45 percent by mass of a metallic detergent having an alkyl or alkenyl group having 20 to 40 carbon atoms, with an alkaline earth metal borate;

[4] the internal combustion engine lubricating oil composition according to any one of [1] to [3] above wherein (B) the content of the metallic detergent overbased with an alkaline earth metal borate is from 0.01 to 15 percent by mass on the basis of the total mass of the lubricating oil composition;

[5] the internal combustion engine lubricating oil composition according to any one of [1] to [4] above wherein (C) the organic molybdenum compound is sulfurized molybdenum dithiocarbamate or sulfurized oxymolybdenum dithiophosphate; and

[6] the internal combustion engine lubricating oil composition according to any one of [1] to [5] above wherein the sulfated ash content is from 0.1 to 1.5 percent by mass.

Advantageous Effect of Invention

According to the present invention, an internal combustion engine lubricating oil composition can be provided, which is reduced in kinematic viscosity and high temperature high shear viscosity as well as in low temperature viscosity while reducing sufficiently friction under mixed lubricating conditions to have further excellent fuel saving properties.

The internal combustion engine lubricating oil composition is suitably used in gasoline engines, diesel engines and gas engines for two- and four-wheeled vehicles, power generators and cogenerations and further not only those using fuel with a sulfur content of 50 ppm by mass or less but also various engines of ships and outboard motors. In particular, the lubricating oil composition is used for automobile internal combustion engines, more preferably automobile gasoline engines, most preferably hybrid vehicle gasoline engines. This is in order to deal with the demand for fuel efficiency while dealing with the most severer exhaust gas regulation.

DESCRIPTION OF EMBODIMENTS

Suitable embodiments of the present invention will be described in more detail below.

The lubricating oil composition for an internal combustion engine according to the present invention comprises (A) a base oil having a 100° C. kinematic viscosity of 2 to 8 $mm^2/s$ and an aromatic content of 10 percent by mass or less, (B) a metallic detergent having a metal ratio of 1.01 to 3.3 overbased with an alkaline earth metal borate and (C) an organic molybdenum compound with a molybdenum concentration of 0.01 to 0.2 percent by mass on the basis of the total mass of the composition, and has a 100° C. HTHS viscosity of 5.5 mPa·s or lower.

The internal combustion engine lubricating oil composition of the present invention contains (A) a lubricating base oil having a 100° C. kinematic viscosity of 2 to 8 $mm^2/s$ and an aromatic content of 10 percent by mass or less (hereinafter referred to as "the lubricating base oil of the present invention").

Examples of the lubricating base oil of the present invention include those having a 100° C. kinematic viscosity of 2 to 8 $mm^2/s$ selected from paraffinic mineral base oils which can be produced by subjecting a lubricating oil fraction produced by atmospheric- and/or vacuum-distillation of a crude oil, to any one of or any suitable combination of refining processes selected from solvent deasphalting, solvent extraction, hydrocracking, hydroisomerizing, solvent dewaxing, catalytic dewaxing, hydrorefining, sulfuric acid treatment, and clay treatment; n-paraffins; and iso-paraffins.

Examples of preferred mineral base oils include base oils produced by refining the following base oils (1) to (7) and/or lubricating oil fractions recovered therefrom in a given process to recover lubricating oil fractions:

(1) a whole vacuum gas oil (WVGO) produced by vacuum distillation of the topped crude of a paraffin-base crude oil and/or a mixed-base crude oil;

(2) a wax produced by dewaxing of lubricating oil (slack wax) and/or a synthetic wax produced through a gas to liquid (GTL) process (Fischer-Tropsch wax, GTL wax);

(3) a mixed oil of one or more types selected from the above base oils (1) and (2) or an oil produced by mild-hydrocracking the mixed oil;

(4) a mixed oil of two or more base oils selected from (1) to (3) above;

(5) a deasphalted oil (DAO) produced by deasphalting a vacuum residue of a topped crude of a paraffin-base crude oil and/or a mixed-base crude oil;

(6) an oil produced by mild-hydrocracking (MHC) the base oil (5);

(7) a mixed oil of two or more base oils selected from (1) to (6) above.

The above-mentioned given refining process is preferably hydrorefining such as hydrocracking or hydrofinishing, solvent refining such as furfural extraction, dewaxing such as solvent dewaxing and catalytic dewaxing, clay refining with acidic clay or active clay, or chemical (acid or alkali) refining such as sulfuric acid treatment and sodium hydroxide treatment. In the present invention, any one or more of these refining processes may be used in any combination and any order.

Furthermore, the lubricating base oil of the present invention is particularly preferably the following base oil (8) produced by subjecting a base oil selected from the above base oils (1) to (7) or a lubricating oil fraction recovered from the base oil to a given treatment:

(8) a hydrocracked mineral oil produced by hydrocracking a base oil selected from the base oils (1) to (7) or a lubricating oil fraction recovered therefrom, and subjecting the resulting product or a lubricating oil fraction recovered therefrom by distillation, to a dewaxing treatment such as solvent or catalytic dewaxing, optionally followed by distillation.

If necessary, a solvent refining process and/or hydrofinishing process may be additionally carried out at appropriate timing upon production of the above lubricating base oil (8).

The viscosity index of the lubricating base oil of the present invention is preferably 100 or greater, more preferably 120 or greater, most preferably 130 or greater and preferably 160 or less, more preferably 150 or less. A viscosity index of less than 100 would not only cause the viscosity-temperature characteristics, thermal/oxidation stability, anti-evaporation properties to degrade but also cause the friction coefficient to increase and likely cause the friction coefficient to increase and cause the anti-wear properties to degrade. A viscosity index of greater than 160 would tend to degrade the low temperature viscosity characteristics.

The viscosity index referred herein denotes the viscosity index measured in accordance with JIS K 2283-1993.

The saturate content of the lubricating base oil of the present invention is preferably 90 percent by mass or more, more preferably 95 percent by mass or more, more preferably 97 percent by mass or more, most preferably 99 percent by mass or more on the basis of the total mass of the lubricating base oil.

A saturate content of less than 90 percent by mass would cause insufficient viscosity-temperature characteristics, thermal/oxidation stability and friction characteristics.

The aromatic content of the lubricating base oil of the present invention is necessarily 10 percent by mass or less, preferably 5 percent by mass or less, more preferably 2 percent by mass or less, more preferably 1 percent by mass or less, particularly preferably 0.5 percent by mass or less on the basis of the total mass of the lubricating base oil.

In order to ensure the solubility of additives, the lubricating base oil contains the aromatic in an amount of preferably 0.01 percent by mass or more, more preferably 0.05 percent by mass or more, more preferably 0.1 percent by mass or more, most preferably more than 0.1 percent by mass.

If the aromatic content exceeds the above upper limit, the resulting composition would tend to be degraded in viscosity-temperature characteristics, thermal/oxidation stability and friction characteristics, and furthermore anti-volatile properties and low temperature viscosity characteristics and moreover the efficacy of additives if added to the lubricating base oil.

No particular limitation is imposed on the % $C_P$ of the lubricating base oil of the present invention, which is, however, preferably 70 or greater, more preferably 80 or greater, more preferably 85 or greater, particularly preferably 88 or greater and preferably 99 or less, more preferably 97 or less, particularly preferably 95 or less. If the % $C_P$ of the lubricating base oil is less than 70, the resulting composition would tend to be degraded in viscosity-temperature characteristics, thermal/oxidation stability and friction characteristics and furthermore the efficacy of additives if added to the lubricating base oil. If the % $C_P$ of the lubricating base oil exceeds 99, the solubility of additives would tend to be degraded.

No particular limitation is imposed on the % $C_N$ of the lubricating base oil of the present invention, which is, however, preferably 3 or greater, more preferably 5 or greater, more preferably 7 or greater and preferably 30 or less, more preferably 20 or less, particularly preferably 15 or less. If the % $C_N$ of the lubricating base oil exceeds 30, the resulting composition would tend to be degraded in viscosity-temperature characteristics, thermal/oxidation stability and friction characteristics. If the % $C_N$ is less than 3, the solubility of additives would tend to be degraded.

No particular limitation is imposed on the % $C_A$ of the lubricating base oil of the present invention, which is, however, preferably 5 or less, more preferably 2 or less, more preferably 1.5 or less, particularly preferably 1 or less. If the % $C_A$ of the lubricating base oil exceeds 5, the resulting composition would tend to be degraded in viscosity-temperature characteristics, thermal/oxidation stability and friction characteristics. Although the % $C_A$ of the lubricating base oil of the present invention may be 0, the use of a lubricating base oil with a % $C_A$ of 0.1 or greater can further enhance the solubility of additives.

No particular limitation is imposed on the ratio of % $C_P$ and % $C_N$ in the lubricating base oil of the present invention, which is, however, preferably 4 or greater, more preferably 6 or greater, more preferably 7 or greater. If the % $C_P$/% $C_N$ is less than 4, the resulting composition would tend to be degraded in viscosity-temperature characteristics, thermal/oxidation stability and friction characteristics, and the efficacy of additives if added to the lubricating base oil would tend to be degraded. The % $C_P$/% $C_N$ is preferably 35 or less, more preferably 20 or less, more preferably 15 or less, particularly preferably 13 or less. The use of a lubricating base with a % $C_P$/% $C_N$ of 35 or less can further enhance the solubility of additives.

The % $C_P$, % $C_N$, and % $C_A$ referred in the present invention denote the percentage of paraffin carbon number in the total carbon number, the percentage of naphthene carbon number in the total carbon number, and the percentages of the aromatic carbon number in the total carbon number, respectively, determined by a method (n-d-M ring analysis) in accordance with ASTM D 3238-85. Specifically, the above-described preferred ranges of the % $C_P$, % $C_N$ and % $C_A$ are based on the values determined by the above-described method, and for example, even if a lubricating base oil does not contain naphthene, the % CN may represent the value of exceeding 0.

The sulfur content of the lubricating base oil of the present invention is preferably 100 ppm by mass or less, more preferably 50 ppm by mass or less, more preferably 10 ppm by mass or less, particularly preferably 5 ppm by mass or less, and most preferably the base oil does not contain sulfur.

The 100° C. kinematic viscosity of the lubricating base oil of the present invention is necessarily 8 $mm^2/s$ or lower, preferably 6 $mm^2/s$ or lower, more preferably 5 $mm^2/s$ or lower, more preferably 4.5 $mm^2/s$ or lower. Whilst, the 100° C. kinematic viscosity is necessarily 2 $mm^2/s$ or higher, preferably 2.5 $mm^2/s$ or higher, more preferably 3 $mm^2/s$ or higher, more preferably 3.5 $mm^2/s$ or higher.

The 100° C. kinematic viscosity used herein refers to the 100° C. kinematic viscosity determined in accordance with ASTM D-445. If the 100° C. kinematic viscosity of the lubricating base oil component exceeds 8 $mm^2/s$, the resulting composition would be degraded in low temperature viscosity characteristics and may not obtain sufficiently improved fuel saving properties. If the 100° C. kinematic viscosity is lower than 2 $mm^2/s$, the resulting lubricating oil composition would be poor in lubricity due to its insufficient oil film formation at lubricating sites and would be large in evaporation loss of the composition.

The lubricating base oil of the present invention may be a synthetic base oil having a 100° C. kinematic viscosity of 2 to 8 $mm^2/s$. Examples of synthetic base oils include poly-α-olefins and hydrogenated compounds thereof; isobutene oligomers and hydrogenated compounds thereof; paraffins; alkylbenzenes; alkylnaphthalenes; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; and polyphenyl ethers. Preferred synthetic lubricating base oils are poly-α-olefins. Typical examples of poly-α-olefins include oligomers or cooligomers of α-olefins having 2 to 32, preferably 6 to 16 carbon atoms, such as 1-octene oligomer, decene oligomer, ethylene-propylene cooligomer, and hydrogenated compounds thereof.

The above lubricating base oils may be used alone or in combination with one or more type of other base oil. When the base oil of the present invention is used in combination with the other base oils, the proportion of the base oil of the present invention in the mixed base oil is preferably 30 percent by mass or more, more preferably 50 percent by mass or more, more preferably 70 percent by mass or more.

No particular limitation is imposed on the other base oils used in combination with the base oil of the present invention. However, examples of the other mineral base oils include mineral base oils and synthetic base oils.

Examples of the mineral base oil include solvent-refined mineral oils, hydrocracked mineral oils, hydrorefined mineral oils, and solvent-dewaxed mineral oils, all of which have a 100° C. kinematic viscosity of higher than 20 $mm^2/s$ and 200 $mm^2/s$ or lower.

Examples of the synthetic base oil include the above-described synthetic base oils which, however, have a 100° C. kinematic viscosity outside the range of 2 to 8 $mm^2/s$.

Component (B) used in the present invention is a metallic detergent having a metal ratio of 1.01 to 3.3, overbased with an alkaline earth metal borate.

Examples of the metallic detergent of the metallic detergent overbased with an alkaline earth metal borate include alkaline earth metal sulfonates, alkaline earth metal salicylates, alkaline earth metal phenates and alkaline earth metal phosphonates.

Examples of the alkaline earth metal sulfonates include alkaline earth metal salts, preferably magnesium and calcium salts, particularly preferably calcium salts of alkyl aromatic sulfonic acids produced by sulfonating alkyl aromatic compounds.

Specific examples of the alkyl aromatic sulfonic acid include petroleum sulfonic acids and synthetic sulfonic acids.

The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating polyolefin to benzene, or those produced by sulfonating alkylnaphthalenes such as dinonylnaphthalene.

The alkyl group is preferably straight-chain.

Sulfonating agents used for sulfonating these alkyl aromatic compounds are generally fuming sulfuric acids or sulfuric anhydride.

Examples of the alkaline earth metal phenate include alkaline earth metal salts, particularly magnesium salts and/or calcium salts of an alkylphenol or alkylphenol sulfide having an alkyl or alkenyl group, and a Mannich reaction product of the alkylphenol. Particularly preferred are sulfur-free alkaline earth metal phenates.

The alkyl group is preferably straight-chain.

Examples of the alkaline earth metal salicylate include salicylates having an alkyl or alkenyl group of alkaline earth metals and/or (overbased) basic salts thereof. Examples of the alkaline earth metal include magnesium, barium, and calcium. Particularly preferred are magnesium and calcium. Preferably used are salicylates having one alkyl or alkenyl group of alkaline earth metal per molecule and/or (overbased) basic salts thereof. For example, those represented by formula (1) below may be used.

(1)

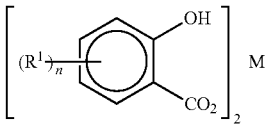

In formula (1), $R^1$ is an alkyl or alkenyl group, M is an alkaline earth metal, preferably calcium or magnesium, particularly preferably calcium, and n is 1 or 2.

No particular limitation is imposed on the method for producing the alkaline earth metal salicylate. Any of known methods for producing monoalkylsalicylates may be used. For example, a monoalkylsalicylic acid is produced by alkylating a phenol as the starting material using an olefin and then carboxylating the phenol or alternatively alkylating salicylic acid as the starting material using a stoichiometric amount of the olefin. The monoalkylsalicylic acid is then reacted with a metal base such as an alkali metal or alkaline earth metal oxide or hydroxide or converted to an alkali metal salt such as sodium salt or potassium salt, which alkali metal salt may be further substituted with an alkaline earth metal.

The metallic detergent used as Component (B) is an oil-soluble metallic detergent overbased with an alkaline earth metal borate.

Any method may be used to produce the oil-soluble metallic detergent overbased with an alkaline earth metal borate. For example, boric acid or boric anhydride is reacted with the above-described metallic detergent in the presence of water, alcohol such as methanol, ethanol, propanol or butanol and a dilution solvent such as benzene, toluene or xylene at a temperature of 20 to 200° C. for 2 to 8 hours, and then heated to a temperature of 100 to 200° C., followed by removal of water and if necessary the alcohol and dilution solvent thereby producing the oil-soluble metallic detergent overbased with an alkaline earth metal borate. These detailed reaction conditions are arbitrarily selected depending on the amounts of the raw material and the reaction product. The details of the method are described in for example Japanese Patent Application Laid-Open Publication Nos. 60-116688 and 61-204298.

The boric acid referred herein are specifically orthoboric acid, metaboric acid and tetraboric acid. Specific examples of the borate include alkali metal salts, alkaline earth metal salts or ammonium salts of boric acid. More specific examples include lithium borate such as lithium metaborate, lithium tetraborate, lithium pentaborate and lithium perborate; sodium borate such as sodium metaborate, sodium diborate, sodium tetraborate, sodium pentaborate, sodium hexaborate and sodium octaborate; potassium borate such as potassium metaborate, potassium tetraborate, potassium pentaborate, potassium hexaborate and potassium octaborate; calcium borate such as calcium metaborate, calcium diborate, tricalcium tetraborate, pentacalcium tetraborate and calcium hexaborate; magnesium borate such as magnesium metaborate, magnesium diborate, trimagnesium tetraborate, pentamagneium tetraborate and magnesium hexaborate; and ammonium borate such as ammonium methaborate, ammonium tetraborate, ammonium pentaborate and ammonium octaborate.

The average particle diameter of the alkaline earth metal borate used for the oil-soluble metallic detergent overbased with an alkaline earth metal borate used as Component (B) is preferably 0.1 μm or smaller, more preferably 0.05 μm or smaller.

The metallic detergent overbased with an alkaline earth metal borate used as Component (B) is desirously salicylate. This is because salicylate reduces friction loss and is most excellent in fuel saving effect.

The metal ratio of Component (B), i.e., metallic detergent overbased with an alkaline earth metal borate used in the present invention is necessarily from 1.01 to 3.3.

The metallic detergent is adjusted to have a metal ratio of preferably 3.2 or less, more preferably 3.0 or less, more preferably 2.8 or less, more preferably 2.4 or less, more preferably 2.2 or less, particularly preferably 2.0 or less, most preferably 1.9 or less. If the metal ratio exceeds 3.3, the friction torque in a driving valve system would be reduced insufficiently.

The metallic detergent is adjusted to have a metal ratio of preferably 1.05 or greater, more preferably 1.1 or greater, more preferably 1.5 or greater, particularly preferably 1.7 or greater, most preferably 1.8 or greater. This is because if the metal ratio is less than 1.01, the resulting internal combustion engine lubricating oil composition would be high in kinematic viscosity and low temperature viscosity and thus would cause problems with lubricity or startability.

Alternatively, the metallic detergent overbased with an alkaline earth metal borate used as Component (B) may be one or a mixture of two or more types of detergents whose metal ratio is from 1.01 to 3.3. Alternatively, other than the detergents with a metal ratio of 1.01 to 3.3, Component (B) may be a mixture with one or more types of detergents whose metal ratio is less than 1.01 and detergents whose metal ratio is greater than 3.3 to be adjusted to have a metal ratio of 1.01 to 3.3. In order to obtain a higher friction reducing effect, a detergent synthesized from a single component is preferably used.

The term "metal ratio" used herein is represented by (valence of metal element in a salicylate detergent)×(metal element content (mole %))/(soap group content (mole %)). The metal element denotes calcium and magnesium. The soap group denotes sulfonic acid, phenol and salicylic acid groups.

In the present invention, Component (B) contains preferably a metallic detergent produced by overbasing a mixture of (B-1) an alkaline earth metallic detergent whose alkyl or alkenyl group has 8 to 19 carbon atoms and (B-2) an alkaline earth metallic detergent whose alkyl or alkenyl group has 20 to 40 carbon atoms with an alkaline earth metal borate.

In the present invention, Component (B) contains preferably (B-1) an alkaline earth metallic detergent whose alkyl or alkenyl group has 8 to 19 carbon atoms and/or a metallic detergent produced by overbasing the alkaline earth metal detergent with an alkaline earth metal borate and (B-2) an alkaline earth metallic detergent whose alkyl or alkenyl group has 20 to 40 carbon atoms and/or a metallic detergent produced by overbasing the alkaline earth metal detergent with an alkaline earth metal borate.

In the present invention, Component (B) contains preferably (B-1) a metallic detergent produced by overbasing an alkaline earth metallic detergent whose alkyl or alkenyl group has 8 to 19 carbon atoms with an alkaline earth metal borate and (B-2) a metallic detergent produced by overbasing an alkaline earth metallic detergent whose alkyl or alkenyl group has 20 to 40 carbon atoms with an alkaline earth metal borate.

The alkyl or alkenyl group of Component (B-1), i.e., alkaline earth metallic detergent is an alkyl or alkenyl group having 8 or more, preferably 10 or more, more preferably 12 or more and 19 or fewer carbon atoms. If Component (B-1) has an alkyl or alkenyl group having fewer than 8 carbon atoms, it would be insufficient in oil solubility.

The alkyl or alkenyl group may be straight-chain or branched but is preferably straight-chain. The alkyl or alkenyl group may be a primary alkyl or alkenyl group, a secondary alkyl or alkenyl group or a tertiary alkyl or alkenyl group, but for the secondary alkyl or alkenyl group or tertiary alkyl or alkenyl group, the position of the branch is preferably only at the carbon bonding to an aromatic.

The metallic detergent overbased with an alkaline earth metal borate as Component (B-2) may be the same as those for Component (B-1) except that the alkyl or alkenyl group has 20 to 40 carbon atoms.

The alkyl or alkenyl group of Component (B-2), i.e., alkaline earth metal detergent is an alkyl or alkenyl group having 20 or more, preferably 22 or more, and 40 or fewer, preferably 30 or fewer carbon atoms. If Component (B-2) has an alkyl or alkenyl group having fewer than 20 carbon atoms, the fuel saving effect that is the purpose of the internal combustion engine lubricating oil composition of the present would be degraded. If Component (B-2) has an alkyl or alkenyl group having more than 40 carbon atoms, the resulting composition would be degraded in low temperature fluidity.

Component (B-1) is contained in an amount of 55 to 100 percent by mass, preferably 60 percent by mass or more, more preferably 65 percent by mass or more, more preferably 70 percent by mass or more on the basis of the total mass of Components (B-1) and (B-2) with the objective of maintaining the low temperature viscosity determined by MRV or the like. If the content of Component (B-1) is less than 55 percent by mass, the friction torque reducing effect in a driving valve system is improved but the resulting internal combustion engine lubricating oil composition would be increased in low temperature viscosity and thus would be degraded in startability at a low temperature and fuel saving property at a low oil temperature.

Component (B-2) is the balance of Component (B-1) in Component (B).

Component (B-2) is contained in an amount of preferably 5 percent by mass or more, more preferably 10 percent by mass or more, more preferably 20 percent by mass or more on the basis of the total mass of Components (B-1) and (B-2) with the objective of improving the friction torque reducing effect in a driving valve system.

In the lubricating oil composition of the present invention, Component (B), i.e., metallic detergent overbased with an alkaline earth metal borate is blended in an amount of 0.01 to 15 percent by mass, preferably 0.5 percent by mass or more, more preferably 1.0 percent by mass or more, more preferably 2 percent by mass or more, most preferably 3 percent by mass or more on the basis of the total mass of the lubricating oil composition. Component (B) is blended in an amount of preferably 10 percent by mass or less, more preferably 7 percent by mass or less, most preferably percent by mass or less.

The content of metal (MB1) derived from Component (B) in the lubricating oil composition of the present invention is preferably from 0.01 to 5 percent by mass, more preferably 0.05 percent by mass or more, more preferably 0.1 percent by mass or more, particularly preferably 0.15 percent by mass or more on the basis of the total mass of the lubricating oil composition. If the content of metal derived from Component (B) is less than 0.01 percent by mass, the anti-oxidation properties and detergency required for an internal combustion engine lubricating oil composition would be degraded. The metal content is preferably 2 percent by mass or less, more preferably 1 percent by mass or less, more preferably 0.5 percent by mass or less, particularly preferably 0.3 percent by mass or less. If the metal content derived from Component (B) exceeds 5 percent by mass, the fuel saving properties would be degraded.

The content of boron (MB2) derived from Component (B) in the lubricating oil composition in the present invention is preferably from 0.01 to 0.2 percent by mass, more preferably 0.02 percent by mass or more, more preferably 0.03 percent by mass or more on the basis of the total mass of the lubricating oil composition. If the content of boron derived from Component (B) is less than 0.01 percent by mass, the fuel saving properties would be degraded. The content of boron is preferably 0.15 percent by mass or less, more preferably 0.1 percent by mass or less, more preferably 0.08 percent by mass or less, particularly preferably 0.07 percent by mass or less. If the content of boron derived from Component (B) exceeds 0.2 percent by mass, the fuel saving properties would be degraded.

The ratio (MB1)/(MB2) of the content of metal derived from Component (B) (MB1) and the content of boron derived from Component (B) (MB2) in the lubricating oil composition of the present invention is preferably 1 or greater, more preferably 2 or greater, more preferably 2.5 or greater. If the (MB1)/(MB2) is less than 1, the fuel saving properties would be possibly degraded. If the (MB1)/(MB2) is preferably 20 or less, more preferably 15 or less, more preferably 10 or less, particularly preferably 5 or less. If the (MB1)/(MB2) exceeds 20, the fuel saving properties would be possibly degraded.

The lower limit content of Component (B) is 0.1 percent by mass or more, preferably 0.2 percent by mass or more, more preferably 0.5 percent by mass or more on a sulfated ash basis of the total mass of the internal combustion engine lubricating oil composition. Whilst, the upper limit content is 1.5 percent by mass or less, preferably 1.0 percent by mass or less, more preferably 0.8 percent by mass or less.

The term "sulfated ash" used herein denotes the amount of sulfated ash measured in accordance with Section 5 "Testing Method of Sulfated Ash" prescribed in JIS K2272-1985 "Testing Methods for Ash and Sulfated Ash of Crude Oil and Petroleum Products".

The content of Component (B) in the lubricating oil composition of the present invention is preferably from 0.1 to 20 percent by mass, more preferably 1.0 percent by mass or more, more preferably 2.0 percent by mass or more, particularly preferably 3.0 percent by mass or more on the basis of the total mass of the lubricating oil composition. If the content of Component (B) is less than 0.1 percent by mass, the fuel saving properties would be possibly degraded. The content of Component (B) is preferably 10 percent by mass or less, more preferably 8.0 percent by mass or less, more preferably 6.0 percent by mass or less, particularly preferably 5.0 percent by mass or less. If the content of boron derived from Component (B) exceeds 20 percent by mass, the fuel saving properties would be possibly degraded.

Component (C) used in the present invention is an organic molybdenum compound. Examples of the organic molybdenum compound include sulfurized molybdenum dithiocarbamate or sulfurized oxymolybdenum dithiophosphate, sulfurized molybdenum dithiophosphate or sulfurized oxymolybdenum dithiophosphate, amine complexes of molybdenum, succinimide complexes of molybdenum, molybdenum salts of organic acids, and molybdenum salts of alcohols. Component (C) used in the present invention is preferably molybdenum dithiocarbamate.

The molybdenum dithiocarbamate may be a compound represented by formula (2) below.

(2)

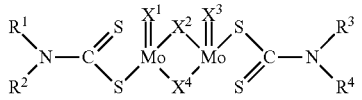

In formula (2) above, $R^1$, $R^2$, $R^3$ and $R^4$ may be the same or different from each other and are each a hydrocarbon group such as an alkyl group having 2 to 24, preferably 4 to 13 carbon atoms or an aryl group (including alkylaryl group) having 6 to 24, preferably 8 to 15 carbon atoms. $X^1$, $X^2$, $X^3$ and $X^4$ may be the same or different from each other and are each sulfur or oxygen. The alkyl or alkenyl group referred herein include a primary alkyl or alkenyl group, a secondary alkyl or alkenyl group or a tertiary alkyl or alkenyl group. These alkyl or alkenyl groups may be straight-chain or branched.

Specific examples of more preferred molybdenum dithiocarbamates include sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum di(butylphenyl)dithiocarbamate, sulfurized molybdenum di(nonylphenyl)dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum di(butylphenyl)dithiocarbamate, and sulfurized oxymolybdenum di(nonylphenyl)dithiocarbamate, all of which the alkyl or alkenyl groups may be straight-chain or branched and the alkyl groups of the alkylphenyl groups and the alkenyl groups may bond to any position, and mixtures thereof. Furthermore, those having in one molecule hydrocarbon groups each having a different carbon number and/or structure from each other are also preferably used.

The content of Component (C) is preferably 100 ppm by mass or more, more preferably 500 ppm by mass or more, more preferably 600 ppm by mass or more, particularly preferably 700 ppm by mass or more on the basis of molybdenum of the total mass of on the internal combustion engine lubricating oil composition with the objective of reducing the friction. Whilst, the content of Component (C) is preferably 2000 ppm by mass or less, more preferably 1500 ppm by mass or less, more preferably 1000 ppm by mass or less from the viewpoint of retention of solubility in the lubricating base oil, storage stability and oxidation stability.

If the content of Component (C) is less than 100 ppm by mass, the resulting composition would be poor in friction reducing effect. If the content of Component (C) exceeds 2000 ppm by mass, Component (C) would possibly precipitate during a long period of storage due to its low solubility in poly-α-olefins or a hydrogenated compound thereof and would be degraded in oxidation stability during a long time use.

The lubricating oil composition of the present invention contains preferably a boronated ashless dispersant as Component (D).

Examples of the boronated ashless dispersant include nitrogen-containing compounds having in their molecules at least one straight-chain or branched alkyl or alkenyl group having 40 to 400 and derivatives thereof and boronated products of alkenylsuccinicimides. Any one or more types selected from these ashless dispersants may be blended in the lubricating oil composition of the present invention.

Component (D) may be any boronated ashless dispersant that has been conventionally used in lubricating oil but is preferably boronated succinimide because of the excellent detergency thereof.

The carbon number of the alkyl or alkenyl group of the ashless dispersant is preferably 40 to 400, more preferably 60 to 350. If the carbon number of the alkyl or alkenyl group is fewer than 40, the ashless dispersant would tend to be degraded in solubility in the lubricating base oil. Whereas, if the carbon number of the alkyl or alkenyl group is more than 400, the resulting lubricating oil composition would be degraded in low-temperature fluidity. The alkyl or alkenyl group may be straight-chain or branched but is preferably a branched alkyl or alkenyl group derived from oligomers of olefins such as propylene, 1-butene or isobutylene or a cooligomer of ethylene and propylene.

The internal combustion engine lubricating oil composition of the present invention may contain either one or both of mono-type and bis-type succinimides.

No particular limitation is imposed on the method of producing these succinimides. For example, a method may be used, wherein an alkyl or alkenyl succinimide produced by reacting a compound having an alkyl or alkenyl group having 40 to 400 carbon atoms with maleic anhydride at a temperature of 100 to 200° C. is reacted with a polyamine. Examples of the polyamine include diethylene triamine, triethylene tetramine, tetraethylene pentamine, and pentaethylene hexamine.

Alternatively, the boronated ashless dispersant may be a boronated benzylamine. Examples of preferred benzylamines are compounds represented by formula (3) below.

(3)

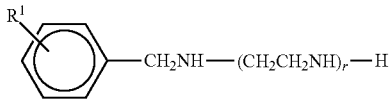

In formula (3), $R^1$ is an alkyl or alkenyl group having 40 to 400, preferably 60 to 350 and r is an integer of 1 to 5, preferably 2 to 4.

No particular limitation is imposed on the method for producing the benzylamines. They may be produced by reacting a polyolefin such as a propylene oligomer, polybutene, or ethylene-α-olefin copolymer with a phenol so as to produce an alkylphenol and then subjecting the alkylphenol to Mannich reaction with formaldehyde and a polyamine such as diethylenetriamine, triethylenetetramine, tetraethylenepentamine, or pentaethylenehexamine.

Alternatively, the boronated ashless dispersant may be a boronated polyamine. Specific examples of the boronated polyamine include boronated compounds represented by formula (4) below.

$$R—NH—(CH_2CH_2NH)s\text{-}H \quad (4)$$

In formula (4), R is an alkyl or alkenyl group having 40 to 400, preferably 60 to 350 and s is an integer of 1 to 5, preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Boronation is generally carried out by allowing the above-described nitrogen-containing compound to react with boric acid to neutralize the whole or part of the remaining amino and/or imino groups.

Examples of a method of producing a boric acid modified-succinimide are those disclosed in Japanese Patent Publication Nos. 42-8013 and 42-8014 and Japanese Laid-Open Patent Publication Nos. 51-52381 and 51-130408. More specifically, a boric acid modified-succinimide may be produced by mixing polyamine and polybutenylsuccinic acid (anhydride) with a boron compound such as boric acid, boric acid ester, or borate in a solvent including alcohols, organic solvent such as hexane or xylene, or a light fraction lubricating base oil and by heating the mixture under appropriate conditions. The boron content of the boron acid-modified succinimide produced in this manner is generally from 0.1 to 45 percent by mass.

No particular limitation is imposed on the boron content in the case of using a boron-containing ashless dispersant such as the above-described boron-containing succinimide, which is, however, usually from 0.1 to 3 percent by mass, preferably 0.2 percent by mass or more, more preferably 0.5 percent by mass or more, more preferably 0.8 percent by mass or more, particularly preferably 1.0 percent by mass or more. The boron content is preferably 2 percent by mass or less, more preferably 1.7 percent by mass or less, more preferably 1.5 percent by mass or less. The boron-containing ashless dispersant is preferably a boron-containing succinimide, particularly desirously a boron-containing bis-type succinimide, with a boron content within the above-described range. If the boron content is more than 3 percent by mass, not only concerns about stability are arisen, but also concerns about influences on an exhaust-gas after-treatment system would be arisen accompanied with an increase in sulfated ash content due to the too much boron in the composition. If the boron content is less than 0.1 percent by mass, the resulting composition is less effective in improving the fuel saving properties and thus is desirously used in combination with another boric compound.

No particular limitation is imposed on the boron/nitrogen mass ratio (B/N ratio) of the boron-containing ashless dispersant such as the above-described boron-containing succinimide, which is usually from 0.05 to 5, preferably 0.2 or greater, more preferably 0.4 or greater, particularly preferably 0.7 or greater. The B/N ratio is preferably 2 or less, more preferably 1.5 or less, more preferably 1.0 or less, more preferably 0.9 or less. The boron-containing ashless dispersant is preferably a boron-containing succinimide with a B/N ratio within this range, particularly desirously a boron-containing bis-type succinimide. If the B/N ratio exceeds 5, not only concerns about stability are arisen, but also concerns about influences on an exhaust-gas after-treatment system would be arisen accompanied with an increase in sulfated ash content due to the too much boron in the composition. If the B/N ratio is less than 0.05, the resulting composition is less effective in improving the fuel saving properties and thus is desirously used in combination with another boric compound.

The content of boron derived from Component (D) of the internal combustion engine lubricating oil composition of the present invention is 0.01 percent by mass or more, preferably 0.02 percent by mass or more, more preferably 0.03 percent by mass or more, particularly preferably 0.04 percent by mass or more on the basis of the total mass of the lubricating oil composition. The boron content is preferably 0.15 percent by mass or less, more preferably 0.1 percent by mass or less, more preferably 0.07 percent by mass or less, particularly preferably 0.05 percent by mass or less.

The molecular weight of Component (D) is determined by the carbon number of alkyl or alkenyl group and structure of the polyamine of the above-described ashless dispersant but is preferably 2500 or greater, more preferably 3000 or greater, more preferably 4000 or greater. Whilst, the molecular weight is preferably 10000 or less, more preferably 8000 or less. If the molecular weight is less than 2500, the resulting composition would be less effective in fuel saving effect. If the molecular weight is greater than 10000, it is substantially difficult to synthesize an ashless dispersant with such a molecular weight.

The boron content of the internal combustion engine lubricating oil composition of the present invention is preferably 450 ppm by mass or more, more preferably 600 ppm by mass or more, more preferably 700 ppm by mass or more, particularly preferably 800 ppm by mass or more on the basis of the total mass of the composition. The boron content is preferably 3000 ppm by mass or less, more preferably 2000 ppm by mass or less, more preferably 1500 ppm by mass or less, particularly preferably 1000 ppm by mass or less. If the boron content is less than 450 ppm by mass, the resulting composition would be less effective in fuel saving effect. Whilst, the boron content is more than 3000 ppm by mass, the resulting composition would be increased in viscosity too high due to too much addition of the additive and would be less effective in fuel saving effect.

In the present invention, the boronated ashless dispersant is more preferably used in combination with a non-boronated ashless dispersant. The non-boronated ashless dispersant denotes that having a structure of the above-described boronated ashless dispersant prior to boronation. Also in this case, succinimide is most preferable.

The reason why the non-boronated ashless dispersant is preferably used in combination is that the boronated succinimide alone results in an unstable boronated compound, which would often precipitate.

The lubricating oil composition of the present invention may be blended with any additives that have been generally used in a lubricating oil depending on the purposes in order to further enhance the properties. Examples of such additives include viscosity index improvers, metallic detergents other than Component (B), friction modifiers other than Component (C), ashless dispersants other than Component (D), antiwear agent (or extreme pressure additive), anti-oxidants, corrosion inhibitors, rust inhibitors, demulsifiers, metal deactivators, anti-foaming agents.

However, in the present invention, metallic detergents other than Component (B) are not preferably contained.

The viscosity index improver is specifically a non-dispersant type or dispersant type ester group-containing viscosity index improver. Examples of such a viscosity index improver include non-dispersant type or dispersant type poly(meth) acrylate viscosity index improvers, non-dispersant type or dispersant type olefin-(meth)acrylate copolymer viscosity index improvers, styrene-maleic anhydride ester copolymer viscosity index improvers, and mixtures thereof. Preferred are non-dispersant type or dispersant type poly(meth)acrylate viscosity index improvers. Particularly preferred are non-dispersant type or dispersant type poly(meth)acrylate viscosity index improvers.

Other examples of the viscosity index improver include non-dispersant type or dispersant type ethylene-α-olefin copolymers or hydrogenated compounds thereof, polyisobutylene and hydrogenated compounds thereof, styrene-diene hydrogenated copolymers, and polyalkylstyrenes.

Examples of the metallic detergents other than Component (B) include normal salt and/or basic salt such as alkali metal/alkaline earth metal sulfonates, alkali metal/alkaline earth metal phenates, and alkali metal/alkaline earth metal salicylates. Examples of the alkali metal include sodium and potassium. Examples of the alkaline earth metal include magnesium, calcium and barium. Preferred are magnesium and calcium. Particularly preferred is calcium.

Examples of the friction modifier other than Component (C) include any compound that is usually used as a friction modifier for lubricating oils, for example ashless friction modifiers.

Examples of such an ashless friction modifier include ashless friction modifiers such as amine compounds, fatty acid esters, fatty acid amides, fatty acids, aliphatic alcohols, and aliphatic ethers, each having at least one alkyl or alkenyl group having 6 to 30 carbon atoms, in particular straight-chain alkyl or alkenyl group having 6 to 30 carbon atoms per molecule. Alternatively, the ashless friction modifier may be one or more types of compounds selected from nitrogen-containing compounds and acid-modified derivatives thereof or various ashless friction modifiers as exemplified in International Publication No. 2005/037967 Pamphlet.

The antiwear agent (or extreme pressure additive) may be any antiwear agent or extreme pressure additive that has been used for lubricating oil. For example, sulfuric-, phosphoric- and sulfuric-phosphoric extreme pressure additives may be used. Specific examples include zinc dialkyldithiophosphate (ZnDTP), phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, disulfides, polysulfides, and sulfurized fats and oils. Among these antiwear agents, preferred are sulfuric extreme pressure additives, and particularly preferred are sulfurized fats and oils.

The anti-oxidant may be an ashless anti-oxidant such as a phenol- or amine-based anti-oxidant, or a metallic anti-oxidant such as a copper- or molybdenum-based anti-oxidant. Specific examples of the phenol-based anti-oxidant include 4,4'-methylene bis(2,6-di-tert-butylphenol) and 4,4'-bis(2,6-di-tert-butylphenol). Specific examples of the amine-based anti-oxidant include phenyl-α-naphthylamines, alkylphenyl-α-naphthylamines and dialkyldiphenylamines.

Examples of the corrosion inhibitor include benzotriazole-, tolyltriazole-, thiadiazole-, and imidazole-types compounds.

Examples of the rust inhibitor include petroleum sulfonates, alkylbenzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil with a 25° C. kinematic viscosity of 1000 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition of the present invention, they are contained in an amount of 0.01 to 10 percent by mass on the total composition mass basis.

The 100° C. HTHS viscosity of the internal combustion engine lubricating oil composition of the present invention is 5.5 mPa·s or lower, preferably 5.2 mPa·s or lower, more preferably 5.1 mPa·s or lower, particularly preferably 5.0 mPa·s or lower. Whilst, the 100° C. HTHS viscosity is preferably 3.5 mPa·s or higher, more preferably 3.8 mPa·s or higher, particularly preferably 4.0 mPa·s or higher, most preferably 4.2 mPa·s or higher.

If the HTHS viscosity exceeds 5.5 mPa·s, the resulting composition would not obtain sufficient fuel saving properties. Furthermore, the low temperature viscosity is also increased, rendering it difficult to start an engine. Whilst, the 100° C. HTHS is lower than 3.5 mPa·s, the resulting composition would lack lubricity.

The 100° C. HTHS viscosity referred herein denotes the high temperature high shear viscosity at 100° C. defined in accordance with ASTM D4683.

The 100° C. HTHS viscosity is influenced by the metal ratio of Component (B). If the metal ratio of Component (B) exceeds 2.0, the resulting composition is degraded in friction reducing effect more than the case where the metal ratio is 1.0. The 100° C. HTHS viscosity is, however, lowered with a higher metal ratio.

Since improvement in fuel economy with an engine oil is significantly influenced by engine friction loss caused by metal surface contacts at low speed (1000 rpm or lower) and also the viscous resistance of fluid film lubrication at higher than 1000 rpm, a lower 100° C. HTHS viscosity is preferable.

Considering comprehensively the environment where an engine oil is used, an engine oil with a friction loss which is lower both at low speed and high speed is most excellent in fuel saving effect. The preferred range of metal ratio of Component (B) is, therefore, within the above-described range.

The 100° C. kinematic viscosity of the internal combustion engine lubricating oil composition of the present invention is preferably 2 to 15 $mm^2/s$, more preferably 12 $mm^2/s$ or lower, more preferably 10 $mm^2/s$ or lower, most preferably 8 $mm^2/s$ or lower. The 100° C. kinematic viscosity of the internal combustion engine lubricating oil composition of the present invention is preferably 5 $mm^2/s$ or higher, more preferably 6 $mm^2/s$ higher, more preferably 6.5 $mm^2/s$ or higher. The 100° C. kinematic viscosity referred herein denotes the viscosity at 100° C. defined by ASTM D-445. It the 100° C. kinematic viscosity is lower than 2 $mm^2/s$, the resulting lubricating oil composition would lack lubricity. If the 100° C. kinematic viscosity exceeds 15 $mm^2/s$, the resulting composition would not obtain the required low temperature viscosity characteristics and sufficient fuel saving properties.

The viscosity index of the internal combustion engine lubricating oil composition of the present invention is preferably within the range of 140 to 400, more preferably 190 or greater, more preferably 200 or greater, particularly preferably 210 or greater, most preferably 220 or greater. If the internal combustion engine lubricating oil composition of the present invention has a viscosity index of less than 140, it would be difficult to improve the fuel saving properties and reduce the low temperature viscosity at −35° C. while maintain the 150° C. HTHS viscosity. If the viscosity index of the internal combustion engine lubricating oil composition of the present invention is greater than 400, the resulting composition would be degraded in evaporability and cause malfunctions caused by the lack of solubility of additives and the incompatibility with seal materials.

Examples

The present invention will described in more detail below with reference to the following Examples and Comparative Examples but are not limited thereto.

[Driving Valve System Motoring Friction Test]

For each of the internal combustion engine lubricating oil compositions of Examples 1 to 6 and Comparative Examples 1 to 6, the friction torques at an oil temperature of 100° C. and a revolution number 350 rpm was measured using an apparatus that can measure the friction torque at a pair of cam and tappet of the driving valve system in a direct strike-type four-cylinder engine. These conditions are effective conditions to show the friction reducing effect at metal contact parts of an engine sliding portion.

The rate of improvement of each composition was calculated based on the friction torque of Comparative Example 2. The results are set forth in Tables 1 and 2.

| | | | | | Comparative Example 1 | Example 1 | Example 2 | Example 3 | Example 4 | Comparative Example 2 |
|---|---|---|---|---|---|---|---|---|---|---|
| Formulation (A) Base Oi Base Oil 1[1)] | | | | mass % | 100 | 100 | 100 | 100 | 100 | 100 |
| Additives (B) | | Overbased calcium salicylate | | in mass % | 5.92 (neutral) | 5.00 | 4.06 | 3.57 | 3.20 | 2.94 |
| | (B-1) | Matal ratio | | | 1.0 | 1.5 | 2.0 | 2.5 | 3.0 | 3.5 |
| | | Chain length C14-18 | | % | 100 | 100 | 100 | 100 | 100 | 100 |
| | (B-2) | Chain length C20-28 | | % | 0 | 0 | 0 | 0 | 0 | 0 |
| | Amount of element derived from | calcium | | mass % | 0.20 | 0.20 | 0.20 | 0.20 | 0.20 | 0.20 |
| | | boron | | mass % | 0 | 0.04 | 0.05 | 0.07 | 0.08 | 0.08 |
| | Additive B in oil | calcium/boron | | | — | 5.0 | 4.0 | 2.9 | 2.5 | 2.5 |
| (C) | | MoDTC[2)] | | in mass % | 0.8 | 0.8 | 0.8 | 0.8 | 0.8 | 0.8 |
| | | ZDTP[3)] | | in mass % | 1.1 | 1.1 | 1.1 | 1.1 | 1.1 | 1.1 |
| | | Amine-based anti-oxidant[4)] | | in mass % | 1.4 | 1.4 | 1.4 | 1.4 | 1.4 | 1.4 |
| (D) | | Ashless dispersant[5)] | | in mass % | 5.5 | 5.5 | 5.5 | 5.5 | 5.5 | 5.5 |
| | | Viscosity index improver(PMA)[6)] | | in mass % | 3.9 | 7.0 | 7.7 | 7.7 | 7.7 | 7.7 |
| Properties | | Kinematic viscosity | 40° C. | $mm^2/s$ | 56.2 | 35.5 | 31.1 | 30.3 | 29.9 | 29.5 |
| | | | 100° C. | $mm^2/s$ | 10.59 | 8.33 | 7.70 | 7.75 | 7.68 | 7.73 |
| | | Viscosity index | | | 182 | 222 | 233 | 243 | 245 | 251 |
| | | HTHS viscosity | 100° C. | mPa · s | 5.56 | 5.36 | 5.21 | 5.04 | 5.02 | 4.99 |
| | | | 150° C. | mPa · s | 2.6 | 2.6 | 2.6 | 2.6 | 2.6 | 2.6 |
| | | CCS viscosity | −35° C. | mPa · s | 4750 | 4450 | 4000 | 3850 | 3800 | 3800 |
| | | MRV Viscosity | −40° C. | mPa · s | 14400 | 10300 | 9000 | 8500 | 8400 | 8800 |
| Performance Friction torque improving rate | | | | % | 6.9 | 9.5 | 7.9 | 4.5 | 3.0 | 0.0 |

[1)]base oil viscosity (100° C.) 4.1 $mm^2/s$, visocosity index 134, pour point −17.5° C., saturate content 99.6%, aromatic content 0.2%, composition (% CP90, % CN10, % CA0%), <1 mass ppm

[2)]alkyl chain length C8/C13, Mo content 10.0%, sulfur content 11.0%

[3)]alkyl chain length C4/C6, secondary, Zn7.8%, P7.2%, S content 15%

[4)]alkyldiphenylamine, nitrogen content 4.5%

[5)]2.0 mass % succinimide, a molecular weight 14000, alkyl group chain length 1900, nitrogen content 0.6 mass %, B content of 0.0

[6)]PAM, Mw 400000, non-dispersant type

| | | | | Example 3 | Example 5 | Example 6 | Comparative Example 3 | Comparative Example 4 | Comparative Example 5 | Comparative Example 6 |
|---|---|---|---|---|---|---|---|---|---|---|
| Formulation (A) Base Oi Base Oil 1[1)] | | | mass % | 100 | 100 | 100 | 100 | 100 | 100 | 100 |
| Additives (B) | | Overbased calcium salicylate | in mass % | 3.57 | 3.63 | 3.67 | 3.66 | 3.71 | 3.69 | 4.25 |
| | (B-1) | Matal ratio | | 2.5 | 2.5 | 2.5 | 2.5 | 2.5 | 2.5 | 2.5 |
| | | Chain length C14-18 | % | 100 | 85 | 70 | 50 | 30 | 15 | 0 |

-continued

| | | | | Example 3 | Example 5 | Example 6 | Comparative Example 3 | Comparative Example 4 | Comparative Example 5 | Comparative Example 6 |
|---|---|---|---|---|---|---|---|---|---|---|
| | (B-2) | Chain length C20-28 | % | 0 | 15 | 30 | 50 | 70 | 85 | 100 |
| | Amount of element derived from Additive B in oil | calcium | mass % | 0.20 | 0.20 | 0.20 | 0.20 | 0.20 | 0.20 | 0.20 |
| | | boron | mass % | 0.07 | 0.07 | 0.07 | 0.07 | 0.07 | 0.07 | 0.07 |
| | | calcium/boron | | 2.9 | 2.9 | 2.9 | 2.9 | 2.9 | 2.9 | 2.9 |
| (C) | | MoDTC[2)] | in mass % | 0.8 | 0.8 | 0.8 | 0.8 | 0.8 | 0.8 | 0.8 |
| | | ZDTP[3)] | in mass % | 1.1 | 1.1 | 1.1 | 1.1 | 1.1 | 1.1 | 1.1 |
| | | Amine-based anti-oxidant[4)] | in mass % | 1.4 | 1.4 | 1.4 | 1.4 | 1.4 | 1.4 | 1.4 |
| (D) | | Ashless dispersant[5)] | in mass % | 5.5 | 5.5 | 5.5 | 5.5 | 5.5 | 5.5 | 5.5 |
| | | Viscosity index improver (PMA)[6)] | in mass % | 7.7 | 7.4 | 7.5 | 7.4 | 7.4 | 7.3 | 7.2 |
| Properties | | Kinematic viscosity 40° C. | $mm^2/s$ | 30.3 | 29.8 | 30.0 | 30.0 | 30.2 | 30.2 | 30.3 |
| | | Kinematic viscosity 100° C. | $mm^2/s$ | 7.75 | 7.49 | 7.54 | 7.51 | 7.53 | 7.54 | 7.58 |
| | | Viscosity index | | 243 | 235 | 236 | 234 | 233 | 234 | 235 |
| | | HTHS viscosity 100° C. | mPa · s | 5.04 | 5.06 | 5.09 | 5.08 | 5.10 | 5.09 | 5.06 |
| | | HTHS viscosity 150° C. | mPa · s | 2.6 | 2.6 | 2.6 | 2.6 | 2.6 | 2.6 | 2.6 |
| | | CCS viscosity −35° C. | mPa · s | 3850 | 3800 | 3950 | 4150 | 4400 | 4500 | 4700 |
| | | MRV Viscosity −40° C. | mPa · s | 8500 | 8600 | 8800 | ≥21300 YS ≥70 | ≥81100 YS ≥350 | ≥400000 YS ≥350 | ≥400000 YS ≥350 |
| Performance | Friction torque improving rate | | % | 4.5 | 5.6 | 7.3 | 7.6 | 8.3 | 8.5 | 8.6 |

[1)]base oil viscosity (100° C.) 4.1 $mm^2/s$, visocosity index 134, pour point −17.5° C., saturate content 99.6%, aromatic content 0.2%, composition (% CP90, % CN10, % CA0%), <1 mass ppm

[2)]alkyl chain length C8/C13, Mo content 10.0%, sulfur content 11.0%

[3)]alkyl chain length C4/C6, secondary, Zn7.8%, P7.2%, S content 15%

[4)]alkyldiphenylamine, nitrogen content 4.5%

[5)]2.0 mass % succinimide, a molecular weight 14000, alkyl group chain length 1900, nitrogen content 0.6 mass %, B content of 0.0

[6)]PAM, Mw 400000, non-dispersant type

The invention claimed is:

1. An internal combustion engine lubricating oil composition comprising:

(A) a base oil having a 100° C. kinematic viscosity of 2 to 8 $mm^2/s$ and an aromatic content of 10 percent by mass or less, (B) a metallic detergent having a metal ratio of 1.01 to 3.3 overbased with an alkaline earth metal borate, and (C) an organic molybdenum compound with a molybdenum concentration of 0.01 to 0.2 percent by mass on the basis of the total mass of the composition, and having a 100° C. HTHS viscosity of 5.5 mPa-s or lower, wherein Component (B) has a mass ratio (MB1/MB2) of a metal content (MB1) derived from component (B) to a boron content (MB2) derived from Component (B) of greater than 2.9 to 20.

2. The internal combustion engine lubricating oil composition according to claim 1 wherein (B) the metallic detergent overbased with an alkaline earth metal borate is an alkaline earth metal salicylate.

3. The internal combustion engine lubricating oil composition according to claim 1 wherein (B) the metallic detergent is a metallic detergent produced by overbasing a mixture of (B-1) 55 to 100 percent by mass of a metallic detergent having an alkyl or alkenyl group having 8 to 19 carbon atoms and (B-2) 0 to 45 percent by mass of a metallic detergent having an alkyl or alkenyl group having 20 to 40 carbon atoms, with an alkaline earth metal borate.

4. The internal combustion engine lubricating oil composition according to claim 1 wherein (B) the content of the metallic detergent overbased with an alkaline earth metal borate is from 0.01 to 15 percent by mass on the basis of the total mass of the lubricating oil composition.

5. The internal combustion engine lubricating oil composition according to claim 1 wherein (C) the organic molybdenum compound is sulfurized molybdenum dithiocarbamate or sulfurized oxymolybdenum dithiophosphate.

6. The internal combustion engine lubricating oil composition according to claim 1 wherein the sulfated ash content is from 0.1 to 1.5 percent by mass.

* * * * *